United States Patent [19]

Goldman

[11] Patent Number: 4,768,829

[45] Date of Patent: Sep. 6, 1988

[54] ADJUSTABLE CHAIR

[75] Inventor: Paul R. Goldman, Andover, Mass.

[73] Assignee: Plycraft Inc., Lawrence, Mass.

[21] Appl. No.: 894,704

[22] Filed: Aug. 7, 1986

Related U.S. Application Data

[63] Continuation of Ser. No. 574,701, Jan. 27, 1984, abandoned.

[51] Int. Cl.[4] ..... A47C 1/02

[52] U.S. Cl. ..... 297/317; 297/322; 297/342; 297/349

[58] Field of Search ..... 297/316, 317, 318, 320, 297/374, 376, 322; 248/411, 412; 192/147, 152

[56] References Cited

U.S. PATENT DOCUMENTS

| | | | |
|---|---|---|---|
| 226,475 | 4/1880 | Bell | 297/317 |
| 809,944 | 1/1906 | Hanger . | |
| 2,400,588 | 5/1946 | McArthur . | |
| 2,591,911 | 4/1952 | Block . | |
| 2,617,471 | 11/1952 | Lorenz . | |
| 3,137,527 | 6/1964 | Hoven et al. | 297/412 |
| 3,337,266 | 8/1967 | Burns | 297/317 |
| 3,773,383 | 11/1973 | Ekornes | 297/320 |
| 3,934,932 | 1/1976 | Ekornes | 297/320 |
| 3,947,069 | 3/1976 | Lusch | 297/317 |
| 4,045,081 | 8/1977 | Ueno | 297/317 |
| 4,068,888 | 1/1978 | Bottemiller | 297/317 |
| 4,251,107 | 2/1981 | Sato | 297/318 |

FOREIGN PATENT DOCUMENTS

| | | | |
|---|---|---|---|
| 154892 | 1/1953 | Australia . | |
| 509060 | 2/1952 | Belgium | 292/147 |
| 373339 | 4/1923 | Fed. Rep. of Germany | 292/147 |
| 2359440 | 6/1974 | Fed. Rep. of Germany | 297/317 |
| 22423 | of 1915 | United Kingdom | 292/147 |
| 434924 | 9/1935 | United Kingdom | 292/147 |
| 681170 | 10/1952 | United Kingdom | 292/147 |

*Primary Examiner*—Francis K. Zugel

*Attorney, Agent, or Firm*—Hale and Dorr

[57] ABSTRACT

The invention features an improvement in an adjustable chair having a base, a seat coupled to the base and arranged to move with respect to the base along a center line plane of the chair, and a back hingedly connected to the seat to allow an adjustment of relative angular reclining position of the seat and back in response to movement of the seat. The claim further has a coupling and guiding assembly for coupling the seat to the base, for guiding forward and backward movement of the seat with respect to the base, and for frictionally holding the seat at any of a continuum of desired positions with respect to the base.

6 Claims, 3 Drawing Sheets

ADJUSTABLE CHAIR

This application is a continuation of application Ser No. 574,701, filed 1/27/84 now abandoned.

BACKGROUND OF THE INVENTION

This invention relates to an improved adjustable chair; and more particularly, to an adjustable chair having frictional securing mechanisms for varying the angular relationship between the seat and back of the chair.

Many adjustable chairs have back and seat portions that can be brought to a desired angular position relative to each other. Various frictional securing mechanisms have been proposed for use in adjusting the chair and holding it in the desired angular position. Many of the proposed mechanisms have locking devices that are expensive to manufacture and/or complicated to operate.

Objects of the invention are therefore to provide continuous relative angular adjustment of the back and the seat of a chair in an effective manner; to provide angular adjustment of a chair that is inexpensive to manufacture and efficient and easy to operate; and to provide a frictional securing mechanism for an adjustable chair that does not require a locking device.

SUMMARY OF THE INVENTION

The present invention relates to an adjustable chair having a base, a seat coupled to the base and arranged to move with respect to the base along plane through a center line of the chair, and a back hinged to the seat to allow an adjustment of the relative angular reclining position of the seat and back in response to movement of the seat. The invention features a coupling and guiding structure for coupling the seat to the base, for guiding forward and backward movement of the seat with respect to the base, and for frictionally holding the seat at any of a continuum of desired positions with respect to the base. The coupling and guiding structure has a coupling element guide attached to the base that extends forwardly of the base and that defines a maximum forward and backward position for the seat with respect to the base. The coupling and guiding structure also has a coupling element, slidably mounted on the guide, that includes a first portion slidably engaging the guide and an outwardly projecting second portion integral with the first portion and arranged to be connected to the seat to move the first portion along the guide in response to movement of the seat with respect to the base. The coupling and guiding structure also has a resilient biasing element arranged to engage the first portion of the coupling element and the coupling element guide and urge the first portion into continuous frictional engagement with the guide.

In a preferred embodiment, the biasing element is a leaf spring disposed between the coupling element and the guide. The guide is a hollow bar connected at one end to the base and extending forwardly from the base beneath the seat and along the center line plane of the chair. The guide has a slot through which the outwardly projecting portion passes. The slot extends a predetermined length along the bar.

In a further preferred aspect of the embodiment, the chair has supports mounted on the base and extending upwardly on either side of the seat. Each support hingedly connects to a side of the back and supports an arm rest arranged for use as a gripping element by a person seated in the chair when moving the seat with respect to the base.

As will be apparent from the description below, a chair having the coupling and guiding structure of the present invention is simple and inexpensive to manufacture and efficient and easy to operate.

DRAWINGS

Other features, objects, and advantages of this invention will become more apparent to one skilled in the art from a reading of the following claims and detailed specification taken with the drawings.

DESCRIPTION OF THE PREFERRED EMBODIMENT

Structure

Figure 1:
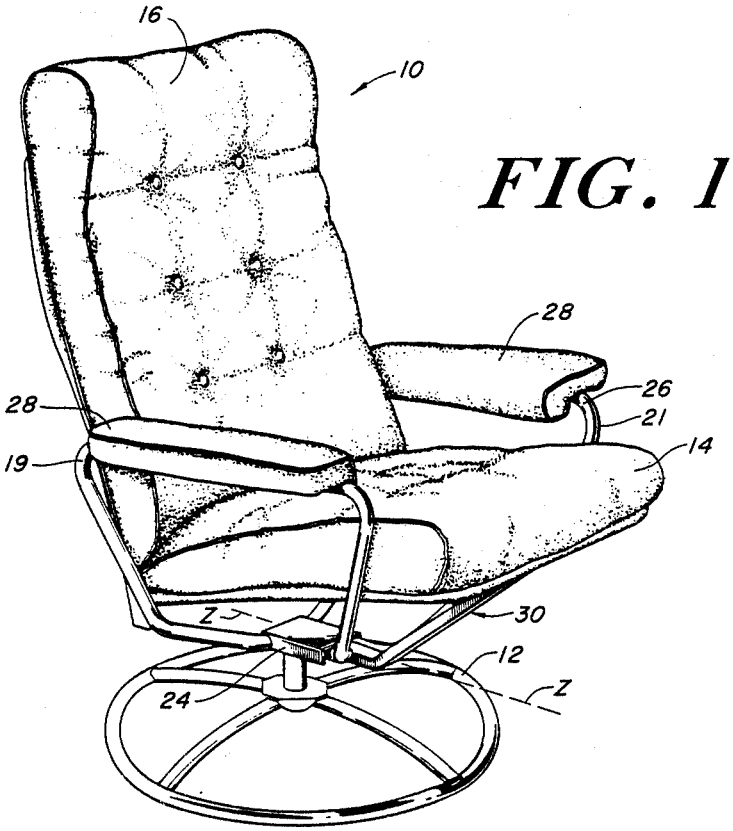
FIG. 1 is a perspective view of a chair embodying the invention.
Figure 2:
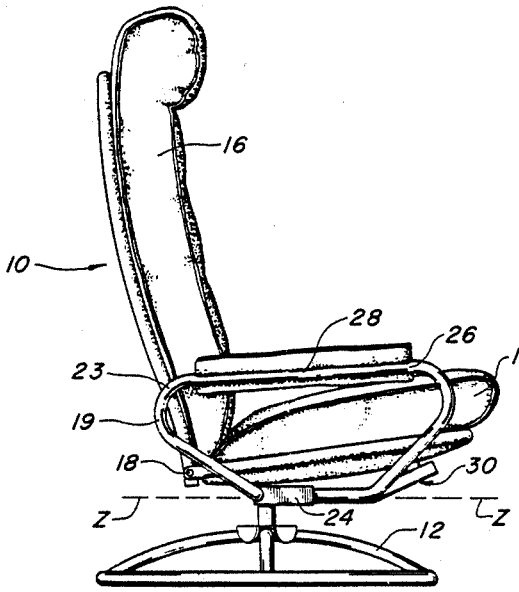
FIG. 2 is an elevation side view of the chair of FIG. 1.
Figure 3:
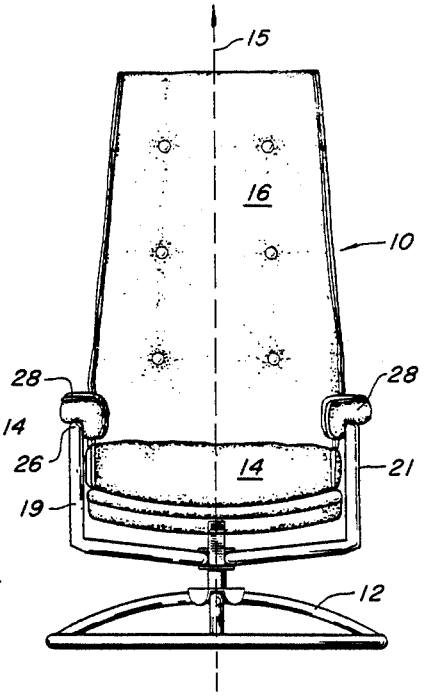
FIG. 3 is a front elevation view of the chair of FIG. 1.

As shown in FIGS. 1, 2 and 3, a chair 10 is provided with a frame base 12, a seat 14 coupled to the base 12 and arranged to move with respect to the base 12 along a plane 15, through a center line Z of chair 10, that divides the chair 10 symmetrically. A back 16 is connected to the seat 14 through a hinge structure 18, which is arranged to allow adjustment of the relative angular reclining position of the seat 14 and the back 16 in response to movement of the seat 14 along the center line plane 15. As shown in the figures, chair 10 is provided with cushioning on the seat 14 and back 16.

Extending on the sides of the chair 10 are a right support frame 19 and a left support frame 21 that are mounted on opposite sides of the base 12. Each support 19, 21 is positioned for use as a gripping element by a person seated in the chair 10 when he or she is moving the seat 14 with respect to the base 12. In the illustrated embodiment, each support is a generally polygonally-shaped frame connected at an apex 24 to the base 12 and having an upper horizontal section 26 for supporting a cushioned armrest 28.

Further, the back 16 is connected to support frames 19, 21 through a hinge structure 23, which is arranged to allow the back 16 to pivot with respect to the frame in response to angular change between the seat 14 and the back 16.

Figure 6:
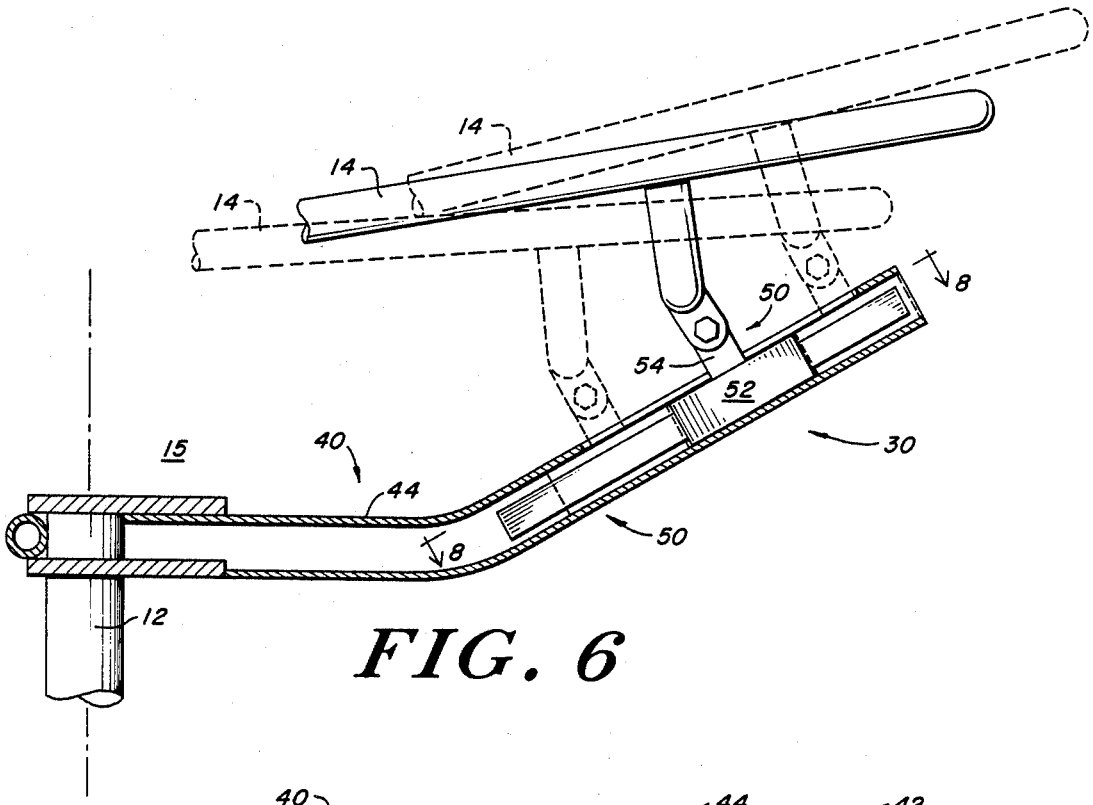
FIG. 6 is a cross-sectional side view of the coupling and guiding structure of the chair of FIG. 1, with its most forward and most rearward positions shown in phantom.
Figure 8:
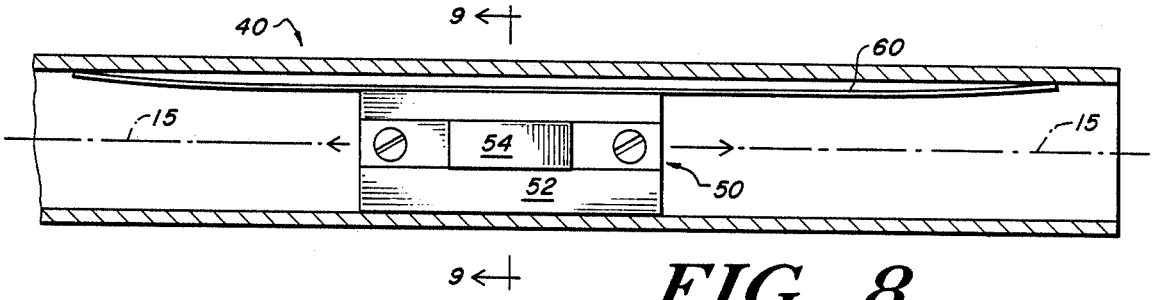
FIG. 8 is a cross-sectional top view of a portion of the guide shown in FIG. 6 taken along lines 8—8 of FIG. 6.
Figure 9:
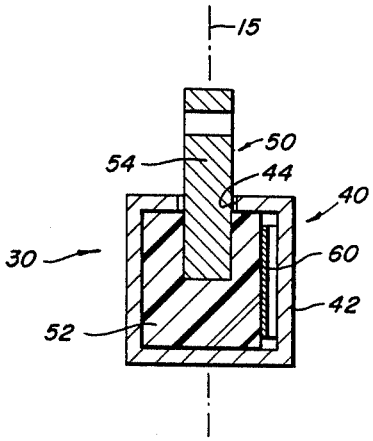
FIG. 9 is a cross-sectional view of the guide of FIG. 8, taken along the lines 9—9 of FIG. 8.

The seat 14 is adjustably connected to and supported by the base 12 through a coupling and guiding structure designated 30. As seen in FIGS. 6, 8 and 9, the coupling and guiding structure 30 has a coupling element 50 attached to the seat 14 and slidably mounted on a coupling element guide 40 that is attached to the base 12 and extends forwardly of the base 12 within the plane 15. The illustrated coupling element 50 has a first portion 52, formed of a non-metallic material and slidably engaging the guide 40, and an upwardly and outwardly projecting second portion 54, formed from metal and screwed to the first portion 52. The second portion 54 is connected to the seat 14 to move the first portion 52 along the guide 40 in response to forward and background movement of the seat 14.

Figure 7:
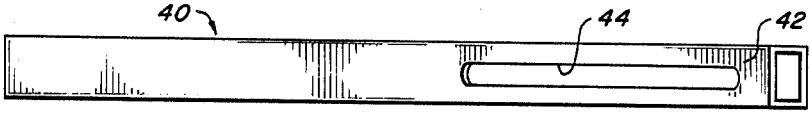
FIG. 7 is a top plan view of the coupling element guide of the coupling and guiding structure shown in FIG. 6 with the coupling element removed.

The coupling element guide 40 defines a range of forward and backward movements for the seat 14 with respect to the base 12. The guide 40 illustrated in FIGS. 6 and 7, consists of a hollow metal bar 42 of generally square cross section connected at one end to the base 12. The bar 42 has a slot 44 at its other, outer, end and carries in its interior the first portion 52 of the coupling element 50. As seen in FIG. 9, portion 54 of the coupling element 50 extends outwardly from the first portion through the slot 44. The slot 44, shown best in FIG. 7, extends a predetermined length along the bar 42 to define maximum forward and rearward movement of the first portion 52 of the coupling element 50 within the bar 42.

Finally, the coupling and guiding structure 30 has a resilient biasing element 60 arranged to engage the coupling element 50 and the guide 40 and urge the coupling element 50 into frictional engagement with the guide 40. As further seen in FIGS. 8 and 9, the illustrated biasing element 60 is a leaf spring disposed within the bar 42 between the first portion 52 and one of the inner surfaces of the bar 42. Spring 60 urges the first portion 52 into frictional contact with the inner surface of the bar 42.

Operation

As stated above, the angular reclining relationship between the seat 14 and the back 16 is changed by moving the seat 14 with respect to the base 12. When the seat 14 is not being moved, the reclining relationship remains unchanged because the leaf spring 60 effects a sufficiently large frictional engagement between the first portion 52 of the coupling element 50 and the guide 40 to prevent the element 50 from moving within the slot 44.

When the seat 14 moves with respect to the base 12, the frictional engagement provided by the leaf spring 60 is overcome and, as best seen in FIG. 6, the first portion 52 of the element 50 moves continuously within bar 42 until either the moving force is removed or protruding portion 54 reaches one of the ends of the slot 44, i.e., until the seat 14 has reached a maximum forward or backward position with respect to the base 12.

Figure 5:
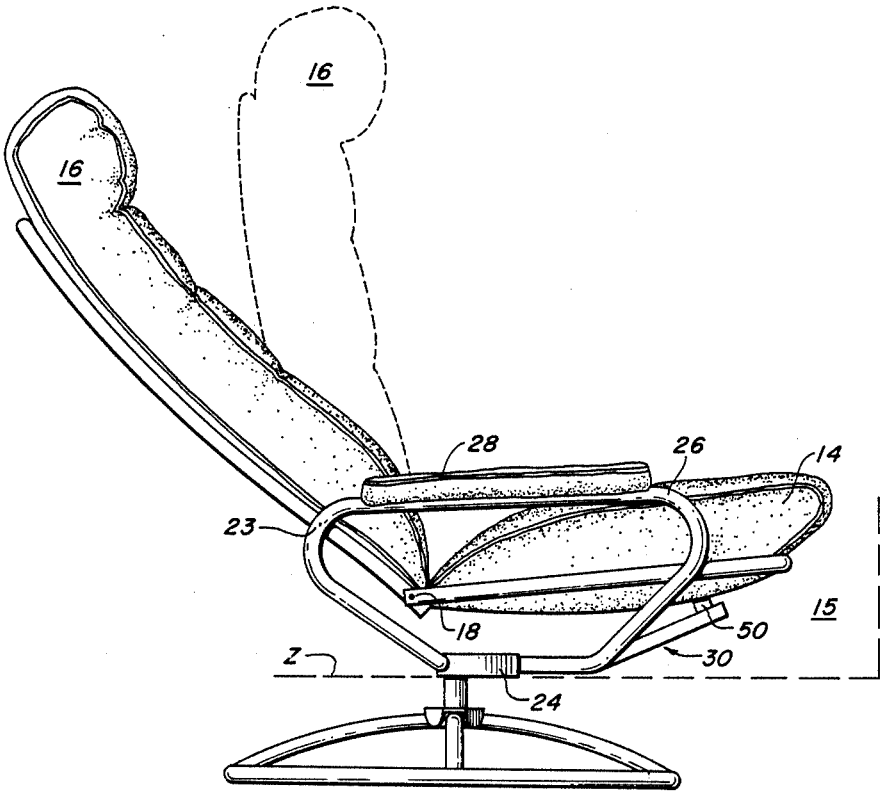
FIG. 5 is a second simplified side view of the chair of FIG. 1 in its most reclined position, and showing a relatively upright back position in phantom.

When the seat 14 is not in its maximum forward position and forward-moving pressure is applied to the seat 14 in the direction of plane 15, the seat 14 moves forward with respect to the base 12, and the first portion 52 of the coupling element 50 moves forward within the bar 42. Because the back 16 is hinged to the seat 14 at the hinge structure 18 and to the frame 19, 21 at the hinge structure 23, the back 16 is forced to pivot at the hinge structure 23 into a less upright back position, in which the angle between the seat 14 and back 16 is increased and the chair 10 is brought into a more reclined position. FIG. 5 shows the chair 10 in its most reclined position, with the seat 14 and coupling element 50 in their most forward position and the back 16 in its least upright position. For comparison, the back 16 is also shown in phantom in a relatively upright position.

Figure 4:
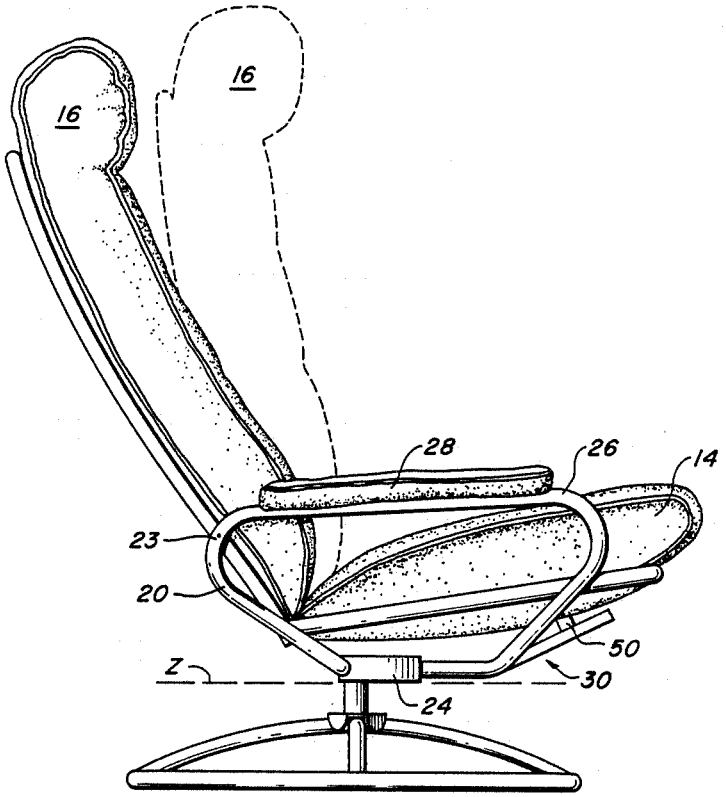
FIG. 4 is a simplified view of the chair of FIG. 1 in an intermediate reclined position, and showing a relatively upright back position in phantom.

When the seat 14 is not in its maximum backward position and backward-moving pressure is applied to the seat 14 in the center line plane 15, the seat 14 moves backward with respect to the base 12 and the first portion 52 moves backward within the bar 42. The back 16 is forced to pivot at hinge structure 23 into a more upright back position, in which the angle between the seat 14 and the back 16 is decreased and the chair 10 is brought into a less reclined position. FIG. 4 shows the chair 10 in an intermediate reclined position in bold and a less reclined position in phanton.

With the adjustable chair 10 described above, the angular reclining relationship between the seat 14 and the back 16 can be controlled by movement of the seat 14 with respect to the base 12. A person seated in the chair 10 can control the amount of reclining by selectively applying forward-moving or backward-moving force on the seat 14, using the arm rests 28, if desired, as a gripping aid.

Thus, it can be seen that a continuous positional adjustment can be accomplished without the need for locking devices. Further, it can be seen that such adjustments can be accomplished even while a person remains seated in the chair 10.

Additions, subtractions, deletions, and other modifications of the invention will be obvious to those practiced in the art and are within the scope of the following claims.

What is claimed is:

1. In an adjustable chair having a base, a frame coupled to said base, a seat arranged to move with respect to said base and said frame along a center line plane of said chair, and a back hingedly connected to said seat by a hinging means that is arranged to allow an adjustment of relative angular reclining position of said seat and said back in response to movement of said seat, the improvement comprising:

a coupling and guiding means, free of variable adjustments, for coupling said seat to said base and for guiding forward and backward movement of said seat with respect to said base and for frictionally holding said seat at any of a continuum of desired positions with respect to said base, said coupling and guiding means having an elongated, hollow coupling element guide attached to said base and extending forwardly of said base and having an elongated opening in a wall thereof facing said seat for defining a maximum forward and backward movement position for said seat with respect to said base, a coupling element slidably mounted substantially within said guide, said element including a first portion slidably engaging said guide and an outwardly projecting second portion integral with said first portion and extending through said opening and pivotably connected to said seat to move said first portion along said guide in response to movement of said seat with respect to said base, and a biasing means contained within said hollow guide and arranged to engage said first portion of said coupling element and an interior wall of said guide, and to urge, with a constant force, said first portion in a horizontal direction into continuous frictional engagement with said guide along an opposing interior wall thereof.

2. The adjustable frame of claim 1, wherein said chair further comprises upright supports mounted on said base and extending on either side of said seat, each support hingedly connected to a side of said back and each support having an arm rest mounted thereon.

3. The adjustable chair of claim 1, wherein said guide comprises a hollow bar having a rectangular cross section and connected at one end of said base and extending substantially along said center line plane of said chair, and a slot in said bar for accepting said second portion of said coupling element and extending a predetermined length along said bar.

4. The adjustable chair of claim 1, wherein said biasing means comprises a leaf spring disposed between said coupling element first portion and said guide.

5. In an adjustable chair having a base, a frame coupled to said base, a seat arranged to move with respect to said base and said frame along a center line plane of said chair, and a back hingedly connected to said seat by a hinging means that is arranged to allow an adjustment of relative angular reclining position of said seat and said back in response to movement of said seat, the improvement comprising:

a coupling and guiding means, free of variable adjustments, for coupling said seat to said base and for guiding forward and backward movement of said seat with respect to said base and for frictionally holding said seat at any of a continuum of desired positions with respect to said base, said coupling and guiding means having an elongated, hollow coupling element guide attached to said base and extending forwardly of said base and having an elongated opening in a wall thereof facing said seat for defining a maximum forward and backward movement position for said seat with respect to said base, said guide having a bar having a rectangular cross section and connected at one end to said base and extending substantially along said center line plane of said chair, and said opening in a top wall of said bar extending a predetermined length along said bar;

a coupling element slidably mounted substantially within said guide, said element including a first portion slidably engaging said guide within said bar and an outwardly projecting second portion integral with said first portion and extending through said opening and pivotably connected to said seat to move said first portion along said guide in response to movement of said seat with respect to said base; and a leaf spring connected within said hollow guide and disposed between said first portion of said coupling element and an interior wall of said guide, and arranged to urge said first portion in a horizontal direction, with a constant force, into frictional engagement with said guide along an opposing interior wall thereof; and said frame having upright supports mounted on said base and extending on either side of said seat, each support hingedly connected to a side of said back and each support having an arm rest mounted thereon.

6. A reclining mechanism for easy chair or swivel chair of the type including a leg base and a chair seat, said mechanism comprising a guide tube firmly secured above the leg base, a jack stay projected from beneath the chair seat; said guide tube being slightly tilted upward at the front portion thereof to form an obliquely extended tube, said extended tube having a guide slot formed on the upper side thereof, a guide bar pivotably connected with the lower end of said jack stay and adapted to pass through said guide slot, said guide bar being provided at the lower end thereof with a sliding member which is contained and slidably movable in said extended tube, a space formed between said sliding member and an inner wall of one side of said obliquely extended tube, and an arc-shaped spring plate mounted on the inner side wall of said extended tube, said spring constantly pressing against said sliding member so as to exert a slow-down effect on the movement of said sliding member.

* * * * *